US006938585B2

(12) United States Patent
Schneider

(10) Patent No.: US 6,938,585 B2
(45) Date of Patent: Sep. 6, 2005

(54) AUTOMATIC ADDITIVE REPLENISHMENT SYSTEM FOR IC ENGINE LUBRICATING OIL

(75) Inventor: Eric West Schneider, Shelby Township Macomb County, MI (US)

(73) Assignee: General Motors Corporation, Detroit, MI (US)

( * ) Notice: Subject to any disclaimer, the term of this patent is extended or adjusted under 35 U.S.C. 154(b) by 292 days.

(21) Appl. No.: 10/278,417

(22) Filed: Oct. 23, 2002

(65) Prior Publication Data

US 2004/0079589 A1 Apr. 29, 2004

(51) Int. Cl.[7] ..... F02B 75/12
(52) U.S. Cl. ..... 123/1 A; 123/196 R; 184/1.5
(58) Field of Search ..... 123/1 R, 1 A, 123/196 R, 196 S, 198 R; 184/1.5

(56) References Cited

U.S. PATENT DOCUMENTS

| | | | | |
|---|---|---|---|---|
| 4,066,559 A | | 1/1978 | Rohde | 252/10 |
| 4,402,912 A | | 9/1983 | Krueger et al. | 422/107 |
| 4,742,476 A | | 5/1988 | Schwaratz et al. | 364/550 |
| 4,847,768 A | | 7/1989 | Schwaratz et al. | 364/424.03 |
| 4,862,393 A | * | 8/1989 | Reid et al. | 123/196 S |
| 4,970,492 A | * | 11/1990 | King | 123/196 S |
| 5,591,330 A | | 1/1997 | Lefebvre | 210/203 |
| 5,718,258 A | | 2/1998 | Lefebvre et al. | 137/268 |
| 6,374,797 B1 | * | 4/2002 | Fischer | 123/196 R |
| 6,435,307 B2 | * | 8/2002 | Selby | 184/1.5 |

FOREIGN PATENT DOCUMENTS

| | | | | |
|---|---|---|---|---|
| JP | 59-96413 A | * | 6/1984 | 184/6.21 |

OTHER PUBLICATIONS

A Model for the Loss of Oxidative Stability of Engine Oil During Long–Trip Service, Part II: Vehicle Measurements, vol. 35(1992), 2, pp. 307–315, Schwaratz.

* cited by examiner

*Primary Examiner*—Noah P. Kamen
(74) *Attorney, Agent, or Firm*—Kathryn A. Marra

(57) ABSTRACT

Method and apparatus for automatically replenishing additives lost from the lubricating oil of an IC engine, by injecting controlled quantities of the additive into the oil. The amount and frequency of injection is controlled by either the operating conditions of the oil (e.g. its thermal history), or changes the properties of the oil (e.g. its electrochemical activity, or dielectric constant).

5 Claims, 3 Drawing Sheets

AUTOMATIC ADDITIVE REPLENISHMENT SYSTEM FOR IC ENGINE LUBRICATING OIL

TECHNICAL FIELD

This invention relates generally to lubrication systems for internal combustion engines, and more particularly to method and apparatus for automatically replenishing additives to the system's lubricating oil that are lost during the operation of the engine.

BACKGROUND OF THE INVENTION

Internal combustion (IC) engines (e.g. spark-, or compression-, ignition engines) have a plurality of moving parts that require lubrication to prevent damage to the engine. Typically, such engines are provided with a lubrication system comprising a sump (a.k.a. crankcase or oil pan) that collects oil that drains from the moving parts, a plurality of passageways in the engine's block and head for delivering oil to the moving parts, and a pump for pumping oil from the sump through the passageways to the moving parts. A filter is commonly located downstream of the pump to remove unwanted particulates from the circulating oil.

The oil used to lubricate internal combustion engines typically contains one or more perishable, life-extending additives. By "perishable" additive is meant an oil additive that either degrades, evaporates, is consumed or is otherwise lost during operation of the engine, and needs replenishing if the oil is to be effective. By "life-extending" additive is meant an additive that forestalls the degradation of the oil, and maintains its effectiveness for an extended period of time. Additives commonly used with lubricating oils include varying amounts of such things as anti-oxidants (e.g. ca. 0.5%–2.0% by wt. aromatic nitrogen compounds), ashless dispersants (e.g. ca. 2%–10% by wt. polyisobutenyl succinimides), wear retardants (e.g. ca. 0.5–2.0% by wt. zinc dithiophosphates), and detergents (e.g. ca. 2–10% by wt. overbased sulfonates), inter alia. Zinc dithiophosphate (ZDP) also functions as an anti-oxidant. The detergents and dispersants are used to neutralize acids and suspend dirt particles that come mainly from blow-by gases (i.e. gases that pass the rings during combustion). The wear retardants, or anti-wear additives, form a sacrificial, protective film on the metal surfaces to protect the metal from wear. The anti-oxidants prevent oxidation of the oil at normal (i.e. 60° C.–130° C.) oil temperatures, and even more so at high (above 130° C.) oil temperatures such as can occur, for example, when operating the engine under severe conditions (e.g. a car/truck pulling a heavy trailer up a steep grade on a hot day). In this later regard, oil oxidizes more rapidly at temperatures above 130° C., than at normal operating temperatures. With increased oil oxidation, comes an undesirable increase in oil viscosity. The anti-oxidants retard oxidation of the oil, but are consumed in the course thereof, and hence are lost from the oil over time—especially at the higher temperatures where the oil is most susceptible to oxidation. The other additives while less sensitive to temperature, are nonetheless lost from the oil over time, usually as a direct function of engine speed and power.

Engine and vehicle manufacturers recommend that the oil be changed at regular intervals to keep additive levels up. For example, General Motors Corporation, assignee of the present invention, recommends for some of its vehicles that: (1) under normal driving conditions, the oil in its gasoline engines should be changed every seventy five hundred (7,500) miles or 12 months which ever comes first; and (2) under severe operating conditions (e.g. frequent short trips in freezing weather, extended idling, trailer towing, driving in dusty areas, frequent stop & go driving, etc.) the oil should be changed every three months or three thousand (3000) miles. Many vehicle operators forget to change their engine oil regularly, which can be detrimental to the engine. Accordingly, most automobile manufacturers have included oil change warning/reminder systems in their vehicles. One such oil change warning/reminder system is described in U.S. Pat. No. 4,742,476 Schwartz et al. , which is assigned to the Assignee of the present invention, and is intended to be incorporated herein by reference.

Schwartz et al., supra, recognized that excessive degradation of the oil occurs at its temperature extremes. At low oil temperatures (i.e. below about 60° C.), fuel, water and soot tend to accumulate in the oil, reducing its viscosity and increasing wear. At high oil temperatures (i.e. above about 130° C.), the anti-oxidants are depleted, the oil becomes viscous and acidic due to oxidation and nitration, and insoluble particles are deposited on the engine surfaces as varnish or sludge. Acidic oil has a reduced ability to prevent rust and corrosion. Schwartz et al., supra, predicts remaining oil life based on the thermal history of the oil (i.e. time-at-temperature, where time is determined in terms of either engine-revolutions or mileage driven). More specifically, Schwartz et al. uses a computer/controller that determines when an oil change is needed based on empirical data and measured values of oil temperature and engine speed (revolutions per minute) or miles driven. The number of engine revolutions (or mileage driven) corresponding to the maximum engine oil life that would occur if the vehicle were continuously driven under conditions least degrading to the lubricating ability of the oil is stored in a non-volatile memory location in the controller. The oil's thermal history is tracked—that is the temperature of the oil is measured, and the duration the oil is at that temperature as recorded while the engine is in operation. In each period of vehicle operation, the stored number is decremented in accordance with an effective engine-revolutions value determined in relation to the product of measured engine revolutions (or mileage driven) and an engine-oil-temperature-based penalty factor that is determined for each engine and oil. When the oil temperature is in an intermediate, ideal range, the penalty factor is set equal to unity, and the effective engine revolution value accumulates at the measured rate. When the oil temperature is outside the ideal range (e.g. 60° C.–130° C.), the penalty factor is set to a value greater than unity in accordance with a predetermined schedule determined for each engine and oil so that the effective engine revolutions value accumulates at a faster rate than the measured rate. The penalty factor to be applied for each temperature and oil is empirically determined for a particular engine, and generally conforms to a stepped trace similar to that designated as "A" of FIG. 5 hereof. The decremented stored number represents the remaining life of the engine oil which is displayed for the vehicle operator. A visual and/or audible warning indication is given when the stored number is decremented below 10% of its original value, indicating the need for an oil change. Rather than directly measuring the oil temperature, the temperature can be determined indirectly by calculations made from measurements taken on other engine operating conditions (e.g. number of combustion firings, coolant temperature, and engine rotational speed), ala the method discussed in Schwartz et al U.S. Pat. No. 4,847,768, which is intended to be incorporated herein by reference.

Sensors have been proposed for directly measuring the condition (i.e. properties) of the oil. For example, Lee et al. U.S. Pat. No. 5,200,027 discloses an oil degradation sensor that uses two roughened, interdigitated electrodes to directly measure the electrochemical properties of the oil. A saw-toothed voltage is applied to the electrodes to generate an electrochemical current that is measured. The magnitude of the measured current is indicative of the condition of the oil—with lower currents indicating newer/fresher oil and higher currents indicating used/degraded oil. Lee et. Al U.S. Pat. No. 5,200,027 is intended to be incorporated herein by reference. Moreover, Meitzer et al. U.S. Pat. No. 4,733,556 (Mar. 29, 1988) teaches method and apparatus for monitoring changes in the dielectric constant of engine oil as an indicator of its remaining useful life. Meitzer et al. U.S. Pat. No. 4,733,556 is intended to be incorporated herein by reference.

It has been proposed to extend the time period between oil changes by simply adding excess quantities of the additives to the oil to insure that a sufficient amount of additive is present at all times. Moreover, it has been proposed to periodically add the additives to the oil regardless of the oil's usage history. Others have proposed other techniques for adding makeup quantities of additives to the oil. Rohde U.S. Pat. No. 4,066,559 fills an additive-permeable, polyolefin container with the additive, and immerses the container in the oil. At elevated temperatures, the additive diffuses through the wall of the container into the oil. The rate at which the additive diffuses out of the container is reduced as the volume of the additive in the container is reduced, and there is no way provided to replenish the additive in the container when the additive content is depleted. DeJovine U.S. Pat. No. 4,144,166, Lefebvre U.S. Pat. No. 5,591,330 and Lefebvre et al U.S. Pat. No. 5,718,258 provide a soluble composite comprising oil additives embedded in an oil-soluble polymer matrix. Oil passing over the composite (e.g. in an oil filter or other canister) dissolves the matrix polymer, and releases the additives into the oil. The dissolved matrix material contaminates the oil, and retards subsequent dissolution over time. All of these techniques have the prospect of adding too much additive to the oil which has a negative affect on vehicle fuel economy and tailpipe emissions. Accordingly, it is desirable to have controlled addition of the additives so as to keep the additive concentration in the oil within prescribed limits.

SUMMARY OF THE INVENTION

The present invention prolongs the useful life of IC engine lubricating oil, and extends the time period between needed oil changes by adding makeup quantities of additives to the oil at essentially the same rate as they are depleted from the oil so as to keep the additive concentration in the oil in a prescribed range over a prolonged period of time. More specifically, the present invention contemplates method and apparatus for prolonging the useful life of an IC engine's lubricating oil by replacing perishable, life-extending additives as they are lost from the oil during engine use. Process-wise the invention comprises: storing a replenishable supply of liquid additive-concentrate (hereafter concentrate) proximate the engine, which concentrate has a concentration of additive greater then the concentration of the additive in the oil; operating the engine under a certain operating condition or conditions (e.g. temperature, power, speed etc.); and injecting the liquid concentrate into the oil at a rate controlled by that operating condition so as to replenish the lost additive at substantially the rate it is lost from the oil. The injection pressure may be provided by a pump, by a hydraulic head of the concentrate in the additive supply system, or by engine-produced pressures (e.g. exhaust gases).

According to one embodiment of the invention, the depletion rate of a particular additive from the oil is determined empirically under a certain engine-operating condition (e.g. temperature, power. etc.) when the engine is running. To determine when more additive is needed in an engine in service, this engine-operating condition is monitored (i.e. by direct measurement, or indirectly by calculation) to determine from the empirical data when a predetermined amount of the additive has been lost from the oil. When the monitored condition indicates that the predetermined amount of additive has been lost, a dose (i.e. a predetermined quantity) of the concentrate is injected into the oil (i.e. "X" quantity of concentrate is added when "Y" amount of additive has been lost).

According to another embodiment of the invention, the method for prolonging the useful life of the lubricating oil comprises sensing a physical property of the oil that is indicative of the degradation of the additive in the oil (e.g. its electrochemical activity, or dielectric constant), and injecting a dose of the concentrate into the oil when the sensing indicates that the degradation has reached a predetermined amount (e.g. X quantity of concentrate is added when the oil has degraded 10%).

According to still another embodiment, the additive is an anti-oxidant, and the concentrate thereof is injected into the oil at a trickle rate determined by the viscosity of the concentrate, the temperature of the oil, the size of the orifice(s) through which the concentrate flows, and the hydraulic head of concentrate.

The invention further comprehends apparatus for effecting the aforesaid method. Apparatus-wise, the invention involves a lubrication system for an internal combustion engine that comprises: a sump for collecting oil drained from the engine's moving parts; a plurality of passageways in the engine for delivering oil to the moving parts; a pump for pumping the oil from the sump into the passageways to lubricate the moving parts; a reservoir containing a concentrate having a concentration of additive therein that is greater then the concentration of the additive in the oil; a nozzle for injecting the additive-concentrate into the oil; a conduit communicating the reservoir and the nozzle for conducting the concentrate from the reservoir to the nozzle; and a pressurizer for applying sufficient pressure on the concentrate to inject it into the oil to replenish additive lost from the oil. In one embodiment, the presuurizer for the concentrate is a second pump, and a sensor is provided to monitor an engine operating condition (e.g. temperature) and report it to a controller that signals activation of the second pump to pump the additive-concentrate into the oil when the monitored condition so warrants. According to another embodiment of the invention, the nozzle comprises a solenoid-operated valve, a sensor monitors an operating condition of the engine and reports it to a controller which, in turn, signals opening of the valve to inject the concentrate into the oil when the monitored condition so warrants. Alternatively, the sensor may comprise a sensor that monitors the condition of the oil (e.g. its electrochemical activity or its changing dielectric constant) and triggers injection of concentrate into the oil when the oil has degraded a predetermined amount.

In still another embodiment: the concentrate comprises an anti-oxidant, and is formulated to have a viscosity that decreases as its temperature increases; the pressurizer is a hydraulic head of liquid concentrate behind the nozzle; and the nozzle includes at least one orifice immersed in the oil and sized to inject the concentrate into the oil at increasing rates as the temperature of the oil increases.

DESCRIPTION OF THE DRAWINGS

The invention will better be understood when considered in the light of the following detailed description of certain specific embodiments thereof which is given hereafter in conjunction with the several drawings in which.

DESCRIPTION OF THE PREFERRED EMBODIMENT

Figure 1:
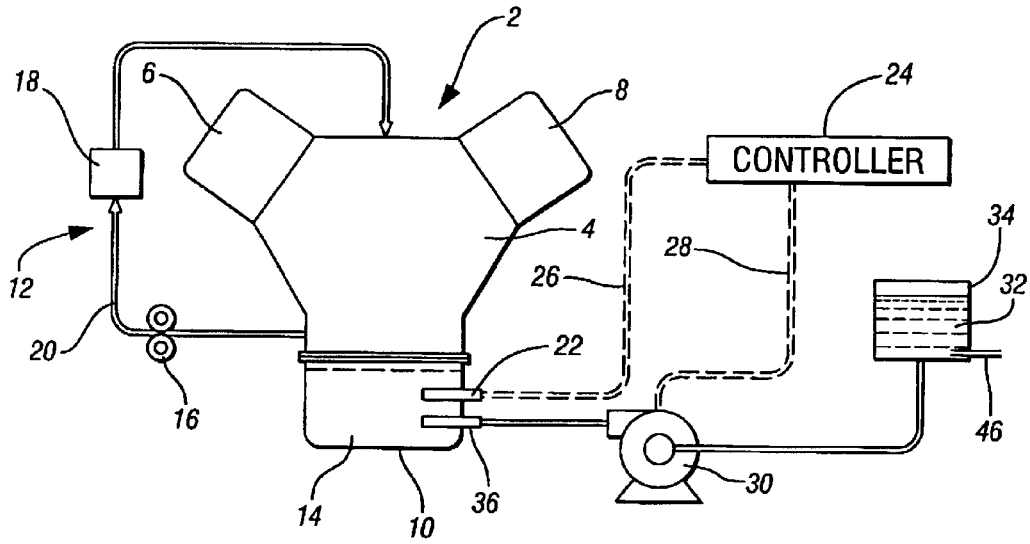
FIG. 1 schematically depicts one embodiment of the present invention.
Figure 2:
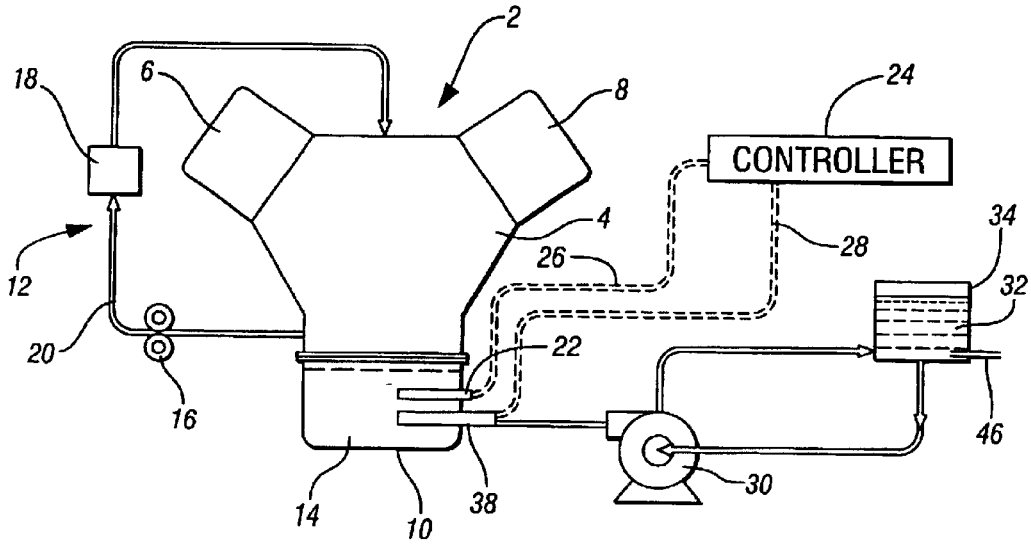
FIG. 2 schematically depicts another embodiment of the present invention.
Figure 3:
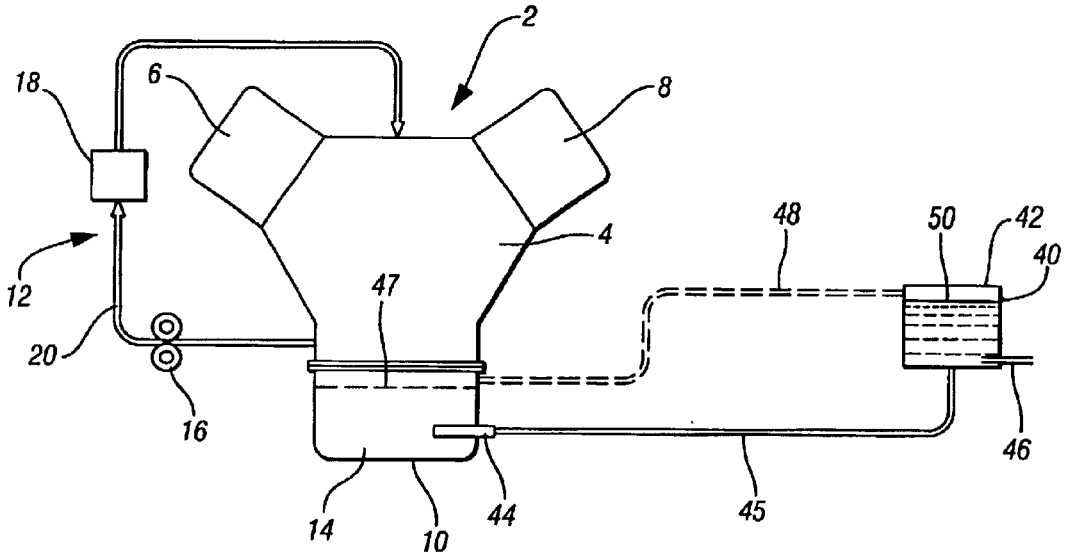
FIG. 3 schematically depicts still another embodiment of the present invention.

FIGS. 1–3 depict an IC engine 2 having a V-block 4, a pair of heads 6 and 8 and an oil pan/crankcase 10. The engine 2 internally includes a lubrication system 12 (here depicted external to the engine) comprising an oil sump 14 in the crankcase 10, an oil pump 16 for circulating the oil through the lubrication system, an oil filter 18 for removing unwanted particulates from the oil, and a plumbing system 20 communicating the sump 14, pump 16 and filter 18 to a network of oil passages (not shown) within the engine 2 for directing the oil to the various moving parts of the engine that require lubrication.

FIG. 1 depicts one embodiment of the invention wherein the crankcase 10 includes a sensor 22 for sensing a condition of the oil (e.g. its temperature, electrochemical activity, dielectric constant etc.) and reporting it to a controller 24 via signal 26. Based on empirically generated data, and using lookup tables and the like, the controller 24 determines when makeup additive is needed when the controller 24 determines that makeup additive is needed, it sends a signal 28 that energizes a pump 30 for a duration of time sufficient to pump a predetermined quantity of concentrate 32 from a reservoir 34 to injection nozzle 36 located somewhere in the lubrication system (here shown, by way of example, to be in the crankcase 10). The reservoir 34 is located proximate the engine 2, and may be either inside or outside of the crankcase 10, as will be discussed in more detail hereinafter in conjunction with FIG. 4. A liquid level sensor 46 in the reservoir 34 alerts the engine operator when the concentrate 32 in the reservoir 34 is low, and needs replenishing.

FIG. 2 shows another embodiment of the invention. The embodiment shown if FIG. 2 is similar to that shown in FIG. 1 except instead of energizing the pump 30 to deliver a predetermined quantity of additive-concentrate to the oil in the lubrication system, the output of the pump 30 is plumbed to (1) circulate concentrate 32 to and from the reservoir 34 under pressure, and (2) divert some of the circulating concentrate to a solenoid-operated injector valve 38 (akin to a fuel injector commonly found in IC engine fuel systems) located somewhere in the lubrication system (here shown at the crankcase 10). In this embodiment, the controller 24 controls the pulse width (i.e. open time) or the frequency of opening of the injector valve 38. Higher oil temperatures will cause the valve to open more frequently. Alternatively, the pump 30 may be eliminated, and the hydraulic head of concentrate in the reservoir 34 used to provide the pressure needed to inject the concentrate into the oil when the injector valve 38 is opened.

The controller for the oil-change warning system of Schwartz et al. U.S. Pat. No. 4,742,476 supra is conveniently adapted for use with the present invention. In this regard, rather than sending an audible or visual signal to the operator that an oil change is needed, Schwartz et al's controller is programmed to automatically dose the oil with concentrate. For example, in the case of an anti-oxidant additive, dosing will preferably occur when the anti-oxidant concentration in the oil falls below about 10% of its prescribed concentration in the oil. Hence, a suitable controller 24 for the present invention will be essentially the same as that employed by Schwartz et al. and includes conventional computer control elements including a clock, a microcomputer, an analog-to-digital converter (A/D), a counter (CTR), a non-volatile memory, and an input/output device (I/O). The clock provides high frequency pulses to the microcomputer, and all of the elements communicate with each other via an address and control bus and a bi-directional data bus. The analog output of the sensor (e.g. temperature sensor) 22 is applied as an input to A/D where it is converted to a digital format and made available for acquisition via the data bus. The digital pulse train output of an engine speed sensor (not shown) is applied as an input to the counter where it is divided down to a rate of one pulse per engine revolution and made available for acquisition via the data bus. An automatic reset switch is provided that has a digital output that is inputted to the I/O device and is triggered each time the oil is dosed to reset the controller. The digital information for controlling the pump 30, or injector valve 38, is outputted as control signal 28 from the I/O device. Eventually, the oil may have to be changed. When it is, the oil change technician, or engine operator, actuates a manual reset switch which is also inputted to the I/O device and resets the controller.

Figure 5:
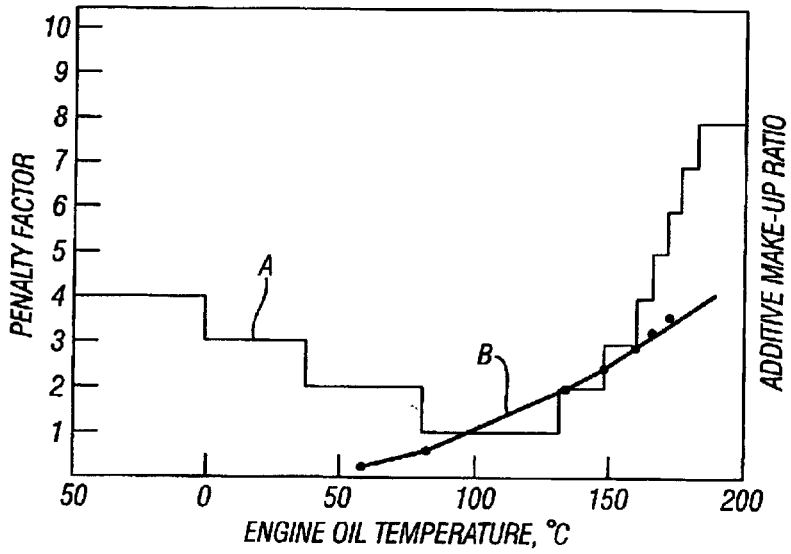
FIG. 5 are plots of oil temperature vs. (1) penalty factors, and (2) additive makeup flow rate for one example of the present invention.

The sensors are conventional sensors well known to those skilled in the art. Thus for example, a temperature sensor may be a varistor element housed in a conductive probe positioned in any location (preferably the crankcase) where the measured oil temperature is representative of the temperature of the oil in the mainstream of oil flow. A speed sensor may be a variable reluctance magnetic pickup cooperating with a toothed ferromagnetic wheel coupled to the engine crankshaft. The manual reset switch may be a conventional momentary-contact single-pole-single-throw switch FIG. 3 shows still another embodiment of the invention. The embodiment shown in FIG. 3 is particularly applicable where the additive is an anti-oxidant (though not limited thereto). FIG. 3 is similar to FIGS. 1 and 2 except that the controller 24, pump 30 (i.e. from FIGS. 1 and 2) and valve 38 are eliminated. Instead, the injection rate of the concentrate 40 is controlled by a combination of (1) the viscosity profile of the concentrate 40, (2) the engine oil temperature, and (3) size of the orifice in the nozzle 44 through which the concentrate flows. The injection pressure is provided by the hydraulic head of the concentrate 40 in the reservoir 42. The anti-oxidant makeup rate is determined by the concentration of the anti-oxidant in the concentrate and the flow rate of the concentrate into the oil. Preferably, the anti-oxidant makeup rate (e.g. see trace B of FIG. 5) will vary as a function of oil temperature, and will approximate the rate at which the penalty factor changes as a function of temperature (e.g. see trace A of FIG. 5). The reservoir 42 contains a supply of the concentrate 40 at a level 50 above the level 47 of the oil in the sump 14. A tube 45 connects the reservoir 42 with the nozzle 44. The reservoir 42 communicates with the crankcase 10, above the oil level 47 and concentrate level 50, by a vent tube 48 to maintain the same pressure in the reservoir 42 and the crankcase 10. As a result, the difference in height between the level 50 of the concentrate 40 in the reservoir 42 and the level 48 of the oil in the crankcase 10 (i.e. the hydraulic head) provides the pressure needed to inject the concentrate 40 into the oil. The concentrate flows through one or more orifices (not shown) in the nozzle 44, which orifice(s) is/are sized to deliver concentrate to the oil at a trickle only when the temperature of the oil in the sump 14 is greater then a predetermined threshold temperature (e.g. 70° C.). The concentrate is formulated such that its viscosity profile (i.e. viscosity vs. temperature) will cause the concentrate to trickle at increasing rates (and hence deliver more concentrate) through the orifice(s) in the nozzle and into the oil as the temperature of the oil increases above the threshold temperature. Below the threshold temperature, no concentrate will flow. Above, but near the threshold temperature (i.e. up to about 130° C.), concentrate will trickle into the oil very slowly. At higher oil temperatures (i.e. up to 160° C. or more) the concentrate will trickle at a faster rate.

In all of the embodiments engine-generated pressure (e.g. exhaust gases) may be substituted for the pump or hydraulic head of concentrate. In this regard, exhaust gases may be routed to the reservoir via a pressure regulator to provide the needed injection pressure. Alternatively, the pressure regulator may be eliminated and the reservoir provided with a pressure relief valve that holds the reservoir at the pressure set by the relief valve.

Additive concentrations in the lubricating oil will vary with the grade of the oil, and the composition of the specific additive. In general, by weight: (1) anti-oxidants will constitute about 0.5% to about 2.0% of the oil; (2) dispersants will constitute about 2% to about 10% of the oil; (3) wear-retardants will constitute about 0.5% to about 2% of the oil; and (4) detergents will constitute about 2% to about 10% of the oil.

Preferably, the concentrate will comprise about 50% by wt. to about 100% by wt.) of at least one anti-oxidant admixed with a mixture of various lubricating oils that, together with the anti-oxidant, provide the desired viscosity profile for a particularly sized nozzle orifice. Concentrate formulations needed to achieve a particular viscosity profile are determined empirically. In this regard, various concentrations of anti-oxidant are mixed with a diluent comprising various proportions of one or more lubricating oils compatible with the engine lubricating oil. The dilutent will preferably comprise different proportions of different single SAE viscosity grade (e.g. SAE 5W–SAE 90W), and/or multi SAE viscosity grades (e.g. 5W30) natural or synthetic lubricating oils.

Figure 4:
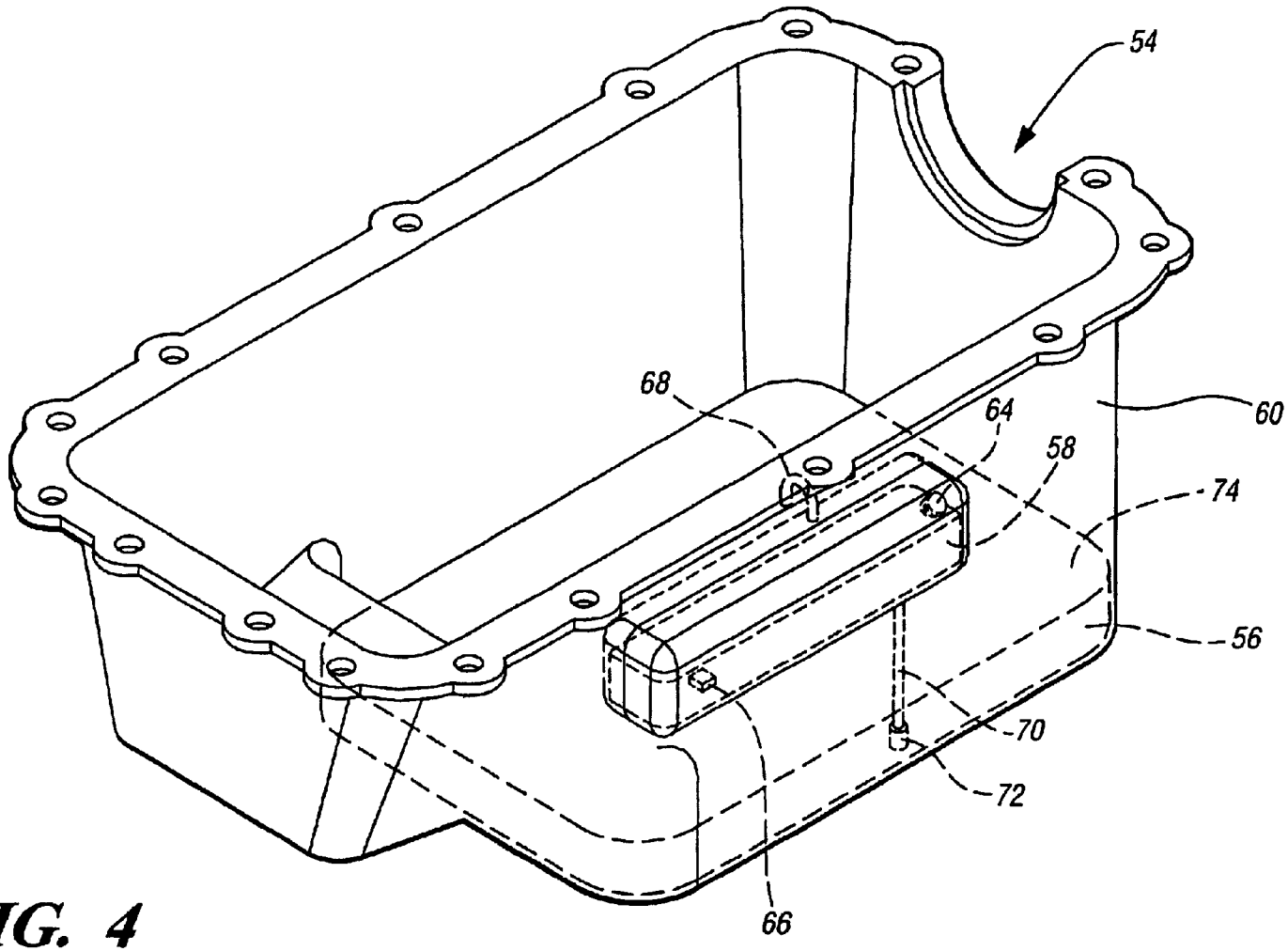
FIG. 4 is an isometric view of an IC engine crankcase according to a preferred embodiment of the present invention.

FIG. 4 depicts a preferred implementation of the embodiment shown in FIG. 3 wherein reservoir 58 containing the concentrate is located inside the oil pan 54 above the level of the oil 56 therein, and is preferably integral with the sidewall 60 of the oil pan. The reservoir 58 will contain a supply of liquid, anti-oxidant concentrate 62 comprising 75% by wt. Of a 50/50 admixture of a phenolic or arylamine anti-oxidant and the balance a mixture of 80% by volume SAE 0W20 viscosity grade oil, and 20% by volume SAE 5W30 viscosity grade oil formulated to have a viscosity profile adapted to provide the temperature-dependant, anti-oxidant flow rate shown in trace "B" of FIG. 5, when coupled with a nozzle having an orifice 0.1 mm in diameter. A filler opening 64 provides access to the inside of the reservoir 58 for replenishing the concentrate 62, as needed. A liquid level sensor 66 is provided through the wall of the reservoir 58 to alert the operator when the concentrate level is low and needs replenishing. A vent tube 68 opens to both the inside of the oil pan 54 and the reservoir 58 to equalize the pressure therebetween. A concentrate supply tube 70 depends from the reservoir 58, and terminates in a nozzle 72 located beneath the surface 74 of the oil 56 in the oil pan 54. The reservoir 58 has a relatively large horizontal cross-section compared to the inside diameter of the tube 70, and the vertical length of the tube 70 is long relative to the depth of the reservoir to minimize the change in pressure of concentrate at the orifice in the nozzle 72, as the concentrate is consumed, and hence maintain the hydraulic head of the concentrate 62 substantially constant. The nozzle 72 comprises one or more orifices (not shown) sized to cooperate with the viscosity of the concentrate 62 to supply concentrate to the oil 56 at increasing rates as the oil temperature rises over the temperature range 60° C. to 160° C.

While the invention has been described in terms of certain specific embodiments thereof, it is not intended to be limited thereto, but rather only to the extent set forth hereafter in the claims which follow.

What is claimed is:

1. Method for prolonging the useful life of lubricating oil in an internal combustion engine, said oil, when fresh, comprising a first concentration of at least one perishable, life-extending additive, comprising storing a replenishable supply of liquid additive-concentrate proximate said engine so as to have a hydraulic head of said additive-concentrate great than that of said oil, said additive-concentrate having a second concentration of said additive greater then said first concentration, operating said engine under a condition that depletes said additive from said oil, and using only said head injecting said additive-concentrate into said oil at a rate controlled by said condition so as to replenish additive lost from said oil.

2. Method according to claim 1 wherein said additive is an anti-oxidant and said condition is an oil temperature greater than 60° C.

3. Lubrication system for an internal combustion engine comprising a sump for collecting oil drained from the engine's moving parts, said oil, when fresh, comprising a first concentration of an anti-oxidant that is depletable from said oil under a certain engine-operating condition, a plurality of passageways in said engine for delivering said oil to said moving parts, a first pump for pumping said oil from said sump into said passageways to lubricate said moving parts, a reservoir containing said anti-oxidant at a second concentration greater then said first concentration and at a predetermined viscosity that decreases as its temperature increases, a nozzle for injecting said anti-oxidant into said oil, said nozzle having at least one orifice immersed in said oil and sized to inject said anti-oxidant into said oil at increasing rates as the temperature of said oil increases above 60° C., and a conduit communicating said reservoir and said nozzle for conducting said anti-oxidant from said reservoir to said nozzle, there being a hydraulic head of said anti-oxidant in said reservoir sufficient to alone inject said anti-Oxidant into said oil to replenish anti-oxidant lost from said oil.

4. An internal combustion engine comprising a crankcase for collecting oil drained from the engine's moving parts, said oil, when fresh, containing a first concentration of at least one perishable, oil-life-extending additive depletable from said oil under a certain engine-operating condition, a plurality of passageways for delivering said oil to said moving ports, a pump for pumping said oil from said crankcase into said passageways under pressure to lubricate said moving parts, a reservoir within said crankcase containing an additive-concentrate having a second concentration of said additive greater then said first concentration, a nozzle beneath said reservoir and immersed in said oil in said crankcase for injecting said additive-concentrate into said oil when the temperature of said oil exceeds 60° C., a conduit depending from said reservoir and communicating with said nozzle for conducting said additive-concentrate from said reservoir to said nozzle, a hydraulic head of said additive-concentrate in said reservoir for applying pressure on said additive-concentrate behind said nozzle to inject said additive-concentrate into said oil to replenish additive lost from sail oil, a filler opening in said reservoir for replenishing said additive-concentrate when depleted from said reservoir, and a liquid level sensor communicating with said reservoir for signaling the operator of the engine when the level of additive-concentrate in said reservoir is low.

5. Method for prolonging the useful life of lubricating oil in an internal combustion engine, said oil when fresh comprising a first concentration of at least one perishable, life-extending additive, comprising storing a replenishable supply of liquid additive-concentrate within said engine, said additive-concentrate having a second concentration of said additive greater then said first concentration, operating said engine under a condition that depletes said additive from said oil, and injecting said additive-concentrate into said oil at a rate controlled by said condition so as to replenish additive lost from said oil, said additive-concentrate having a hydraulic head sufficient to alone effect said injecting.

* * * * *